US010668987B1

(12) United States Patent
Murphy

(10) Patent No.: US 10,668,987 B1
(45) Date of Patent: Jun. 2, 2020

(54) METHOD AND APPARATUS FOR MOTORIZED SIT DOWN HYDROFOIL

(71) Applicant: Michael Murphy, Canyon Lake, CA (US)

(72) Inventor: Michael Murphy, Canyon Lake, CA (US)

( * ) Notice: Subject to any disclaimer, the term of this patent is extended or adjusted under 35 U.S.C. 154(b) by 0 days.

(21) Appl. No.: 15/990,615

(22) Filed: May 26, 2018

(51) Int. Cl.
*B63B 1/24* (2020.01)

(52) U.S. Cl.
CPC ..... *B63B 1/244* (2013.01); *B63B 1/246* (2013.01); *B63B 1/248* (2013.01)

(58) Field of Classification Search
CPC ..... B63B 1/244; B63B 1/246; B63B 1/248; B63B 1/24
See application file for complete search history.

(56) References Cited

U.S. PATENT DOCUMENTS

2003/0143906 A1* 7/2003 Murphy ..... B63B 35/812 441/72
2011/0275257 A1* 11/2011 Jarnot ..... B63H 11/08 440/40
2015/0104985 A1* 4/2015 Langelaan ..... B63H 21/17 440/6
2018/0099734 A1* 4/2018 Schibli ..... B63H 16/08

* cited by examiner

*Primary Examiner* — Stephen P Avila
(74) *Attorney, Agent, or Firm* — Heimlich Law, PC; Alan Heimlich, Esq.

(57) ABSTRACT

A Method and Apparatus for Motorized Sit Down Hydrofoil have been disclosed. By using a seat with a seatbelt and bindings to secure a rider to a top of a board having a hydrofoil assembly on the bottom of the board a rider can be protected from drowning due to an overturned board.

18 Claims, 5 Drawing Sheets

METHOD AND APPARATUS FOR MOTORIZED SIT DOWN HYDROFOIL

FIELD OF THE INVENTION

The present invention pertains to water sports. More particularly, the present invention relates to a Method and Apparatus for Motorized Sit Down Hydrofoil.

BACKGROUND OF THE INVENTION

Hydrofoiling, also known as foiling, has traditionally been achieved by towing behind a boat, or a personal watercraft, or a kite. However, having a tow line can impose limitations on what can be done and where. This presents a problem for which a technical solution using a technical means is needed.

BRIEF DESCRIPTION OF THE DRAWINGS

The invention is illustrated by way of example and not limitation in the figures of the accompanying drawings in which.

DETAILED DESCRIPTION

Figure 1:
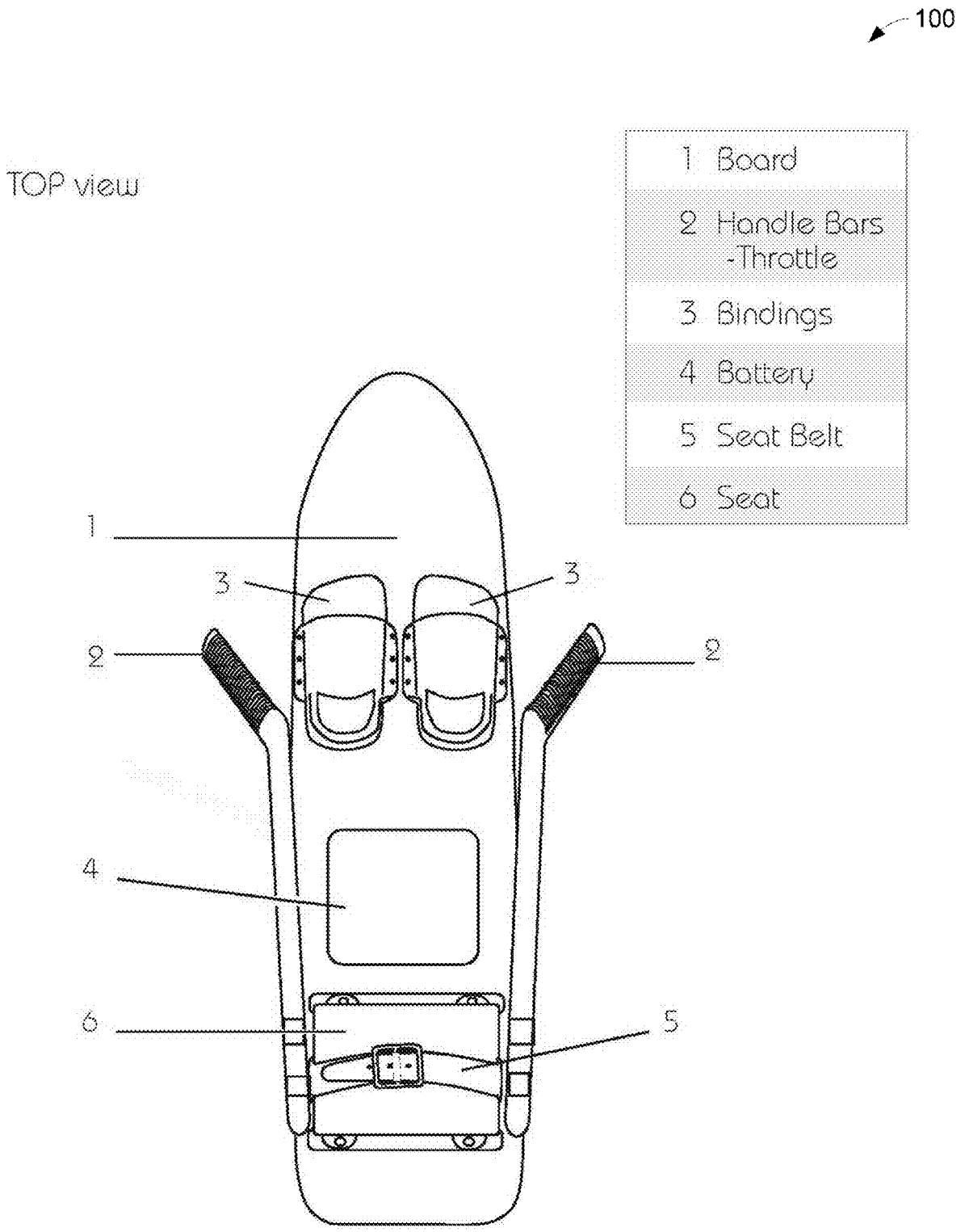
FIG. 1 illustrates a top view of an embodiment of the present invention.

In one embodiment of the invention, the motorized sit down hydrofoil has a mechanism to secure the rider's buttocks into a seat and the rider's feet into bindings.

In one embodiment of the invention, the motorized sit down hydrofoil can be turned or steered by moving the rider's knees to the left or right.

In one embodiment of the invention, the motorized sit down hydrofoil can be raised or lowered by moving the rider's shoulders forward or backward.

In one embodiment of the invention, the motorized sit down hydrofoil can be raised by moving the rider's shoulders backward.

In one embodiment of the invention, the motorized sit down hydrofoil can be lowered by moving the rider's shoulders forward.

In one embodiment of the invention, the motorized sit down hydrofoil can be deep water started. That is the motorized sit down hydrofoil does not require a floating start.

In one embodiment of the invention, the motorized sit down hydrofoil cannot be flipped over such that the rider's head would be underwater.

In one embodiment of the invention, the motorized sit down hydrofoil cannot run over the rider.

In one embodiment of the invention, the motorized sit down hydrofoil has the rider secured and so the rider can perform overhead flips without falling out.

In one embodiment of the invention, the hydrofoil's major components are a board, a handlebar/throttle, bindings, a battery, a seat, a seat belt, a hydrofoil assembly, a motor/engine with a propulsion unit, a front and rear wing (foil assembly), and a fuselage.

In one embodiment of the invention, the power source (motor/engine) can be an electric motor, or gas powered engine, or multi motors and engines.

In one embodiment of the invention, the engine/motor can power a propeller, or impeller, or a water jet drive (propulsion unit).

In one embodiment of the invention it eliminates the need to buy a boat, fuel, towing the boat to and from the lake, storing the boat, etc.

In one embodiment of the invention, the hydrofoil can have a handlebar and throttle mechanism, seat belt, plus foot bindings.

In one embodiment of the invention, by being seated on the hydrofoil rather than standing, kneeling, or laying on the hydrofoil, the hydrofoil needs less positive buoyancy as the rider does not need to be on top of the water. With the rider securely attached to the hydrofoil there is no way the rider can float upside down and potentially drown when falling. Nor can a rider fall off the hydrofoil and get hit with the foil assembly or propeller resulting in serious injuries or death. Additionally, having the rider securely attached to the hydrofoil allows the rider to jump the hydrofoil into the air, or do inverted aerobatics.

In one embodiment of the invention, this motorized sit down hydrofoil has a seat belt and optionally foot bindings securing it to the rider so they will not be hit by the hydrofoil, and with the neutral flotation of the board and the weight of the foil assembly (wings), the hydrofoil can be self righting much like the keel on a sailboat or a fishing bobber, eliminating the possibility of drowning.

As depicted in the drawings the motor/engine (power unit) can be mounted on the hydrofoil at various locations. This is one way to attach the power unit but it is not so limited. The power unit can also be attached to the wings, out the rear of the fuselage, or on the hydrofoil above the wings. It can also be attached to the leading or trailing edge of the hydrofoil but is not limited to such.

In one embodiment of the invention, the speed is controlled by the rider. The rider can have a set of handlebars coming from the seat or deck of the board, and this is potentially a location for the throttle, but not limited to such. The handlebars can also hold the rider more secure to the board, resulting in more safety and control.

In one embodiment of the invention, the throttle is located on the handlebars. The handlebars can be fixedly attached or pivotally attached to the board or a seat.

In one embodiment of the invention, there are no handlebars and the throttle is attached to the seat. In this embodiment if the rider is thrown forward they will not hit any handlebars since there are none. The throttle can be attached to any part of the seat, for example, the front or rear, or left or right side. Also the throttle could have a dead man's switch on the top of the seat.

In one embodiment of the invention, there are no handlebars and the throttle control is via a wireless remote (or smartphone application) that the rider can hold, or attach to anything, for example part of any clothing, the board, the seat, etc. for example via VELCRO®.

In the drawings we show a mono front wing configuration (shape). This shape or design can also be a bi-wing or tri-wing, but is not limited to such.

FIG. 1 illustrates, generally at 100, one embodiment of the invention showing a top view with major parts illustrated. At 1 is a board. At 2 is a handlebar/throttle assembly. At 3 are bindings used for securing a rider's feet to the board (1). At 4 is a battery. At 5 is a seat belt, and at 6 is a seat. Seat 6 and seat belt 5 secure a rider to the board.

Figure 2:
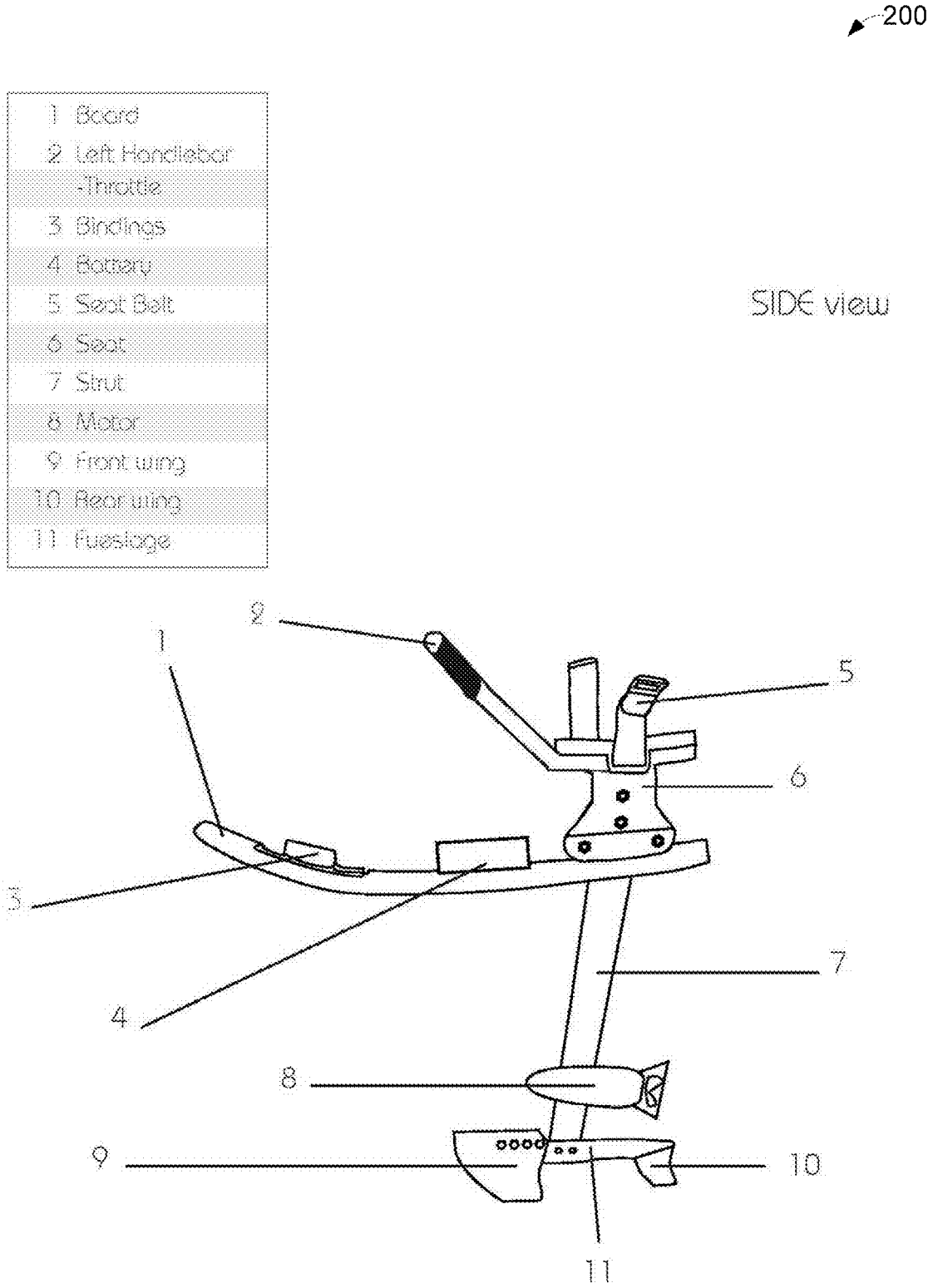
FIG. 2 illustrates a side view of an embodiment of the present invention.

FIG. 2 illustrates, generally at 200, one embodiment of the invention showing a side view with major parts illustrated. At 1 is a board. At 2 is a handlebar/throttle assembly. At 3 are bindings used for securing a rider's feet to the board (1). At 4 is a battery. At 5 is a seat belt, and at 6 is a seat. Seat 6 and seat belt 5 secured a rider to the board. At 7 is a strut. At 8 is a motor. At 9 is a front wing. At 10 is a rear wing. At 11 is a fuselage. A hydrofoil assembly is the strut 7, the fuselage 11, and one or more of the wings (9 and 10).

Figure 3:
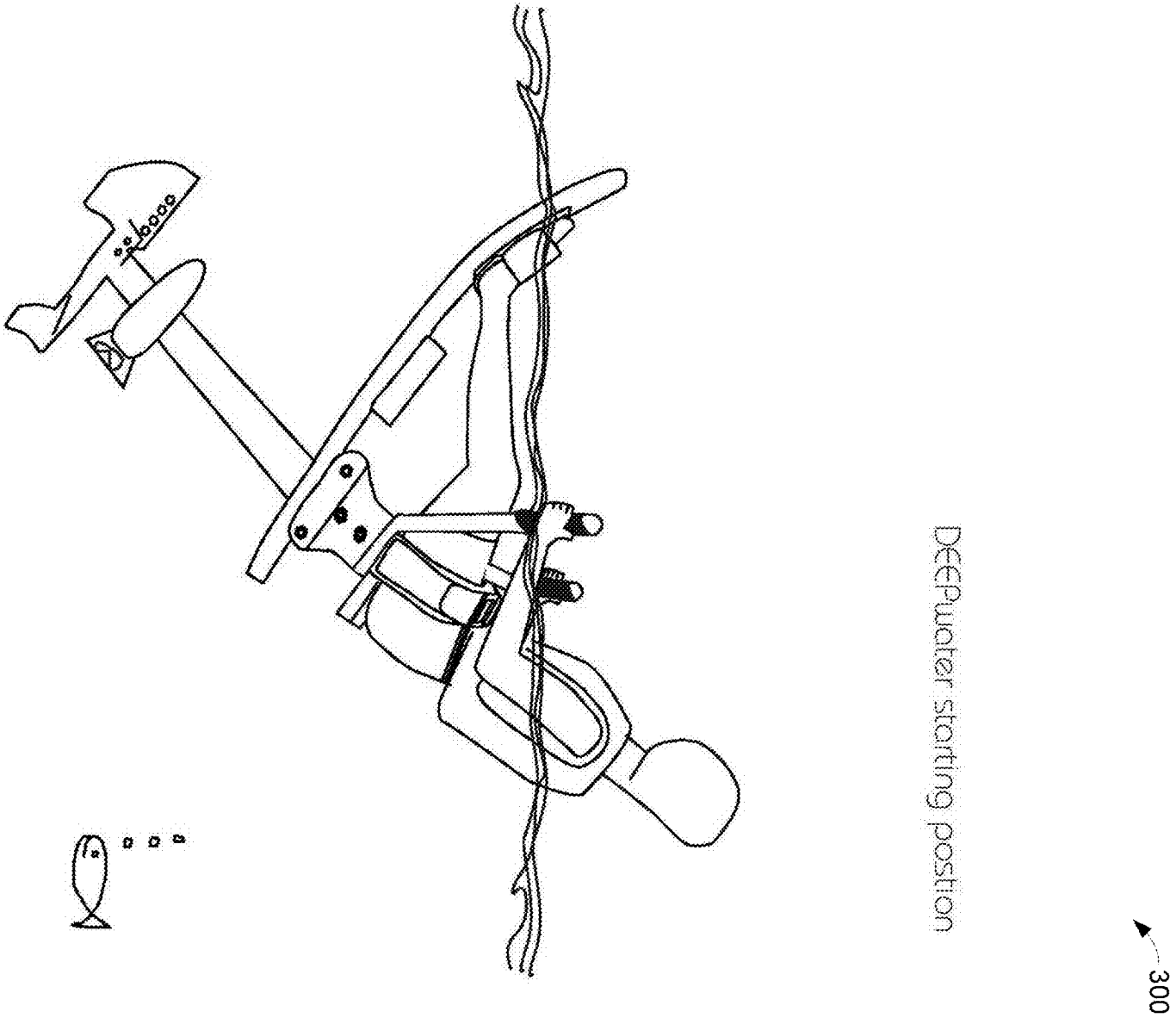
FIG. 3 illustrates a side view of an embodiment of the present invention showing a floating starting position in the water.

FIG. 3 illustrates, generally at 300, one embodiment of the invention showing a floating starting position in the water. Here the rider is wearing a floatation safety device (life jacket, or life vest) and can be seen attached to the motorized sit down hydrofoil before being propelled in the water. As can be seen the front part of the board is angled upwards out of the water. In this way when the motorized sit down hydrofoil begins to move forward it will plane on the water initially and then lift out of the water when the wings provide sufficient lift. The rider can steer side to side by, for example, using their knees pointed in a given direction. The rider can raise or lower the hydrofoil by, for example, leaning forward or backward.

Figure 4:
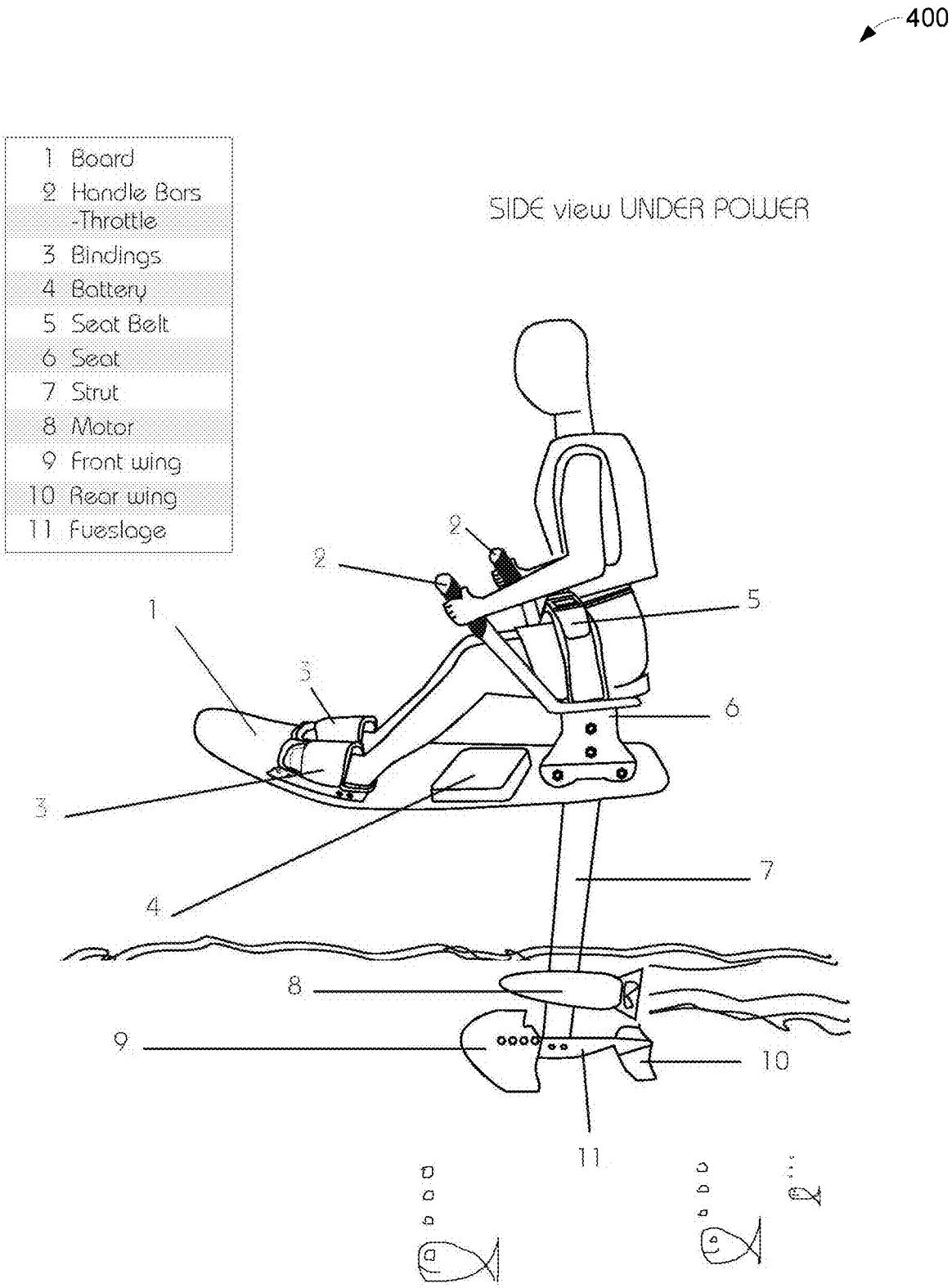
FIG. 4 illustrates a view of an embodiment of the present invention showing a flying position while under power.

FIG. 4 illustrates, generally at 400, one embodiment of the present invention showing a flying position when under power. At 1 is a board. At 2 is a handlebar/throttle assembly. At 3 are bindings used for securing a rider's feet to the board (1). At 5 is a seat belt, and at 6 is a seat. Seat 6 and seat belt 5 secure a rider to the board. At 7 is a strut. At 8 is a motor. At 9 is a front wing. At 10 is a rear wing. At 11 is a fuselage. A hydrofoil assembly is the strut 7, the fuselage 11, and one or more of the wings (9 and 10). As shown the wings have provided enough lift that the board and the rider are out of the water. The rider can steer side to side by, for example, using their knees pointed in a given direction. The rider can raise or lower the hydrofoil by, for example, leaning forward or backward.

Figure 5:
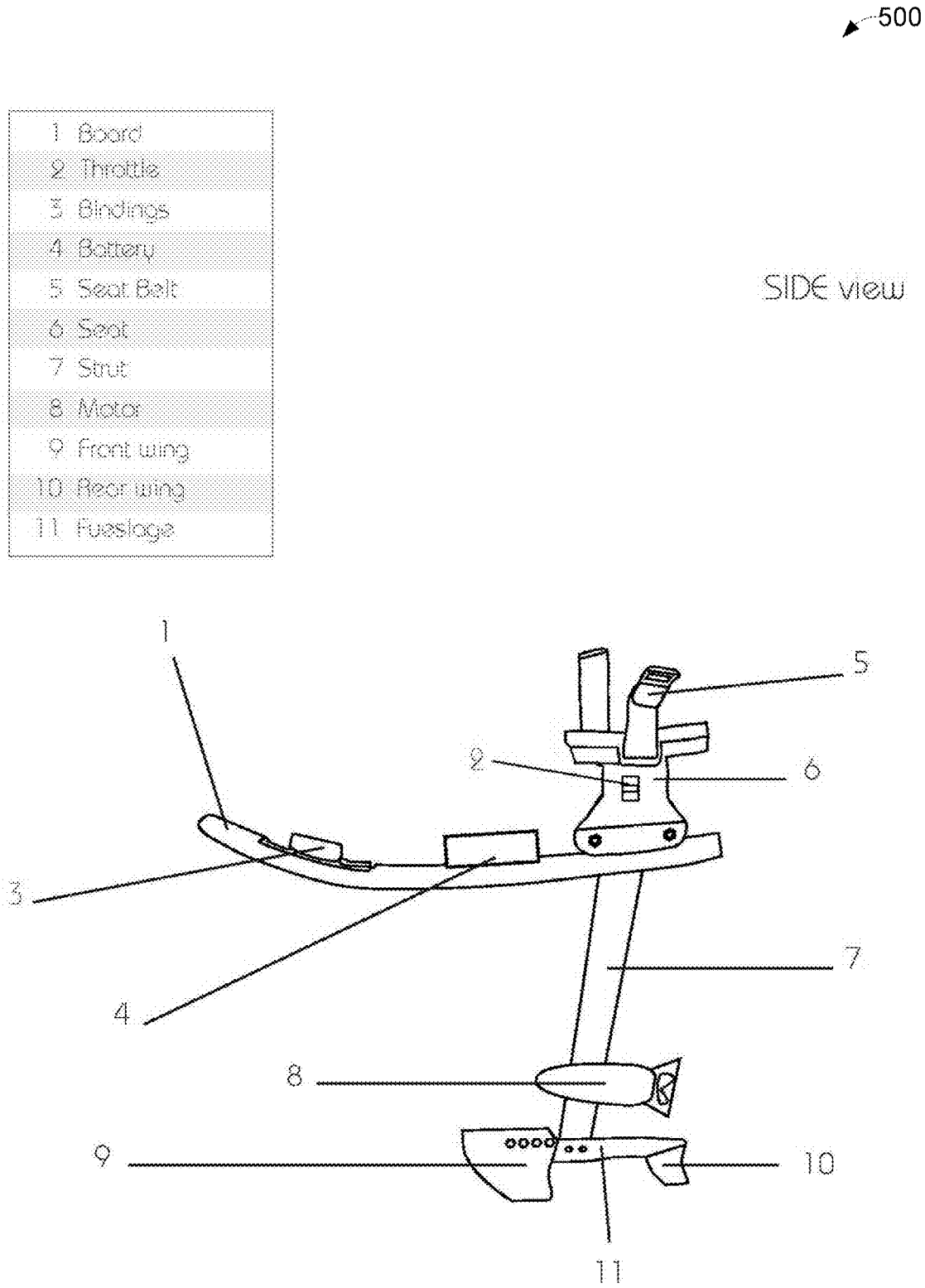
FIG. 5 illustrates a side view of an embodiment of the present invention.

FIG. 5 illustrates, generally at 500, one embodiment of the invention showing a side view with major parts illustrated. At 1 is a board. At 2 is a throttle assembly mounted on a seat. At 3 are bindings used for securing a rider's feet to the board (1). At 4 is a battery. At 5 is a seat belt, and at 6 is a seat. Seat 6 and seat belt 5 secured a rider to the board. At 7 is a strut. At 8 is a motor. At 9 is a front wing. At 10 is a rear wing. At 11 is a fuselage. A hydrofoil assembly is the strut 7, the fuselage 11, and one or more of the wings (9 and 10).

While the illustrations show the strut attached near the rear of the board, the invention is not so limited and the strut may be mounted in other locations on the bottom of the board.

Thus a Method and Apparatus for Motorized Sit Down Hydrofoil have been described.

For purposes of discussing and understanding the invention, it is to be understood that various terms are used by those knowledgeable in the art to describe techniques and approaches. Furthermore, in the description, for purposes of explanation, numerous specific details are set forth in order to provide a thorough understanding of the present invention. It will be evident, however, to one of ordinary skill in the art that the present invention may be practiced without these specific details. In some instances, well-known structures and devices are shown in block diagram form, rather than in detail, in order to avoid obscuring the present invention. These embodiments are described in sufficient detail to enable those of ordinary skill in the art to practice the invention, and it is to be understood that other embodiments may be utilized and that logical, mechanical, electrical, and other changes may be made without departing from the scope of the present invention.

As used in this description, "one embodiment" or "an embodiment" or similar phrases means that the feature(s) being described are included in at least one embodiment of the invention. References to "one embodiment" in this description do not necessarily refer to the same embodiment; however, neither are such embodiments mutually exclusive. Nor does "one embodiment" imply that there is but a single embodiment of the invention. For example, a feature, structure, act, etc. described in "one embodiment" may also be included in other embodiments. Thus, the invention may include a variety of combinations and/or integrations of the embodiments described herein.

As used in this description, "substantially" or "substantially equal" or similar phrases are used to indicate that the items are very close or similar. Since two physical entities can never be exactly equal, a phrase such as ""substantially equal" is used to indicate that they are for all practical purposes equal.

It is to be understood that in any one or more embodiments of the invention where alternative approaches or techniques are discussed that any and all such combinations as might be possible are hereby disclosed. For example, if there are five techniques discussed that are all possible, then denoting each technique as follows: A, B, C, D, E, each technique may be either present or not present with every other technique, thus yielding 2^5 or 32 combinations, in binary order ranging from not A and not B and not C and not D and not E to A and B and C and D and E. Applicant(s) hereby claims all such possible combinations. Applicant(s) hereby submit that the foregoing combinations comply with applicable EP (European Patent) standards. No preference is given any combination.

Thus a Method and Apparatus for Motorized Sit Down Hydrofoil have been described.

What is claimed is:

1. A personal motorized sit down hydrofoil apparatus for use by a user comprising:

a board, the board having a top side and a bottom side;

a handlebar/throttle assembly attached to a seat;

one or more bindings attached to the top side of the board;

the seat attached to the top side of the board; and wherein the user is not towed by a tow line, and a starting position of the board is substantially submerged in water.

2. The motorized sit down hydrofoil apparatus of claim 1 further comprising a seat belt attached to the seat.

3. The motorized sit down hydrofoil apparatus of claim 2 further comprising a hydrofoil assembly attached to the bottom side of the board.

4. The motorized sit down hydrofoil apparatus of claim 3 wherein the hydrofoil assembly comprises a strut having a first end and a second end, the strut first end attached to the bottom side of the board, and the strut second end attached to a fuselage, and one or more wings attached to the fuselage.

5. The motorized sit down hydrofoil apparatus of claim 4 wherein the fuselage one or more wings are selected from the group consisting of a front wing, a rear wing, and a front wing and a rear wing.

6. The motorized sit down hydrofoil apparatus of claim 5 wherein the hydrofoil assembly has attached to it a motor.

7. The apparatus of claim 6 wherein the motor has attached to it a propulsion unit selected from the group consisting of a propeller, an impeller, and a water jet drive.

8. The apparatus of claim 7 wherein a throttle on the handlebar/throttle assembly controls a speed of the motor.

9. The apparatus of claim 1 wherein the handlebar/throttle assembly attached to the seat is attached selected from the group consisting of fixedly attached, and pivotally attached.

10. A method for protecting a rider on a motorized sit own hydrofoil the method comprising:

providing a board, the board having a top side and a bottom side;

providing one or more bindings attached to the top side of the board;

providing a seat attached to the top side of the board;

providing a seat belt attached to the seat;

providing for securing the rider into the seat by using the seat belt, and providing for securing the rider into the one or more bindings; and wherein the rider is not towed by a tow line, and a starting position of the board is substantially submerged in water.

11. The method of claim 10 further comprising:

providing a hydrofoil assembly attached to the bottom side of the board, and wherein the hydrofoil assembly with the rider secured to the board positions the top side of the board so that a head of the rider is out of water.

12. A personal motorized sit down hydrofoil apparatus for use by a user comprising:

a board, the board having a top side and a bottom side;

one or more bindings attached to the top side of the board;

a seat attached to the top side of the board; and wherein the user is not towed by a tow line, and a starting portion of the board is substantially submerged in water.

13. The motorized sit down hydrofoil apparatus of claim 12 further comprising a throttle control selected from the group consisting of a throttle control attached to the top side of the board, a throttle control attached to the seat, and a wireless throttle control.

14. The motorized sit down hydrofoil apparatus of claim 13 further comprising a hydrofoil assembly attached to the bottom side of the board.

15. The motorized sit down hydrofoil apparatus of claim 14 wherein the hydrofoil assembly comprises a strut having a first end and a second end, the strut first end attached to the bottom side of the board, and the strut second end attached to a fuselage, and one or more wings attached to the fuselage.

16. The motorized sit down hydrofoil apparatus of claim 15 wherein the fuselage one or more wings are selected from the group consisting of a front wing, a rear wing, and a front wing and a rear wing.

17. The motorized sit down hydrofoil apparatus of claim 16 wherein the hydrofoil assembly has attached to it a motor.

18. The apparatus of claim 17 wherein the motor has attached to it a propulsion unit selected from the group consisting of a propeller, an impeller, and a water jet drive.

* * * * *